United States Patent [19]

Rye

[11] 4,192,694

[45] Mar. 11, 1980

[54] SOLID OR MOLTEN REAGENT TREATMENT OF METAL TIRE CORD

[75] Inventor: Grover W. Rye, Cuyahoga Falls, Ohio

[73] Assignee: The Goodyear Tire & Rubber Company, Akron, Ohio

[21] Appl. No.: 931,231

[22] Filed: Aug. 4, 1978

Related U.S. Application Data

[63] Continuation of Ser. No. 644,672, Dec. 29, 1975, abandoned.

[51] Int. Cl.[2] ..... B29H 9/10

[52] U.S. Cl. ..... 148/6.11; 427/434.6; 156/124; 428/465

[58] Field of Search ..... 156/124; 428/465; 427/185, 189, 431, 434 D, 434 E; 148/6.11

[56] References Cited

U.S. PATENT DOCUMENTS

| | | | |
|---|---|---|---|
| 2,240,862 | 5/1941 | Schade | 428/465 |
| 3,364,053 | 1/1968 | Beike | 427/185 |
| 3,846,160 | 11/1974 | Hirakawa | 156/124 |

*Primary Examiner*—Ralph S. Kendall

*Attorney, Agent, or Firm*—H. C. Young, Jr.

[57] ABSTRACT

Brass coated steel tire cord is treated with solid or molten benzotriazole and/or other treatment agents to promote corrosion resistance and cord to rubber adhesion retention.

6 Claims, No Drawings

SOLID OR MOLTEN REAGENT TREATMENT OF METAL TIRE CORD

This is a continuation of application Ser. No. 644,672 filed Dec. 29, 1975 abandoned.

This invention relates to the treatment of brass coated steel cord to prevent corrosion of the cord and to improve cord/rubber adhesion retention.

Pneumatic vehicle tires are often reinforced by means of cords prepared from brass coated steel filaments. This tire cord is frequently high carbon steel or high carbon steel cord with a thin layer of alpha brass. The cord may be a monofilament, but normally is prepared from several filaments which are stranded together. The filament is coated with brass, cold drawn and then stranded to form the cord. In most instances, normally depending upon the type of tire being reinforced, the strands of filaments are further cabled to form the final cord.

Brass plated steel wire tire cords are subject to corrosion of the steel structure and oxidation of the brass plating if improperly handled prior to incorporation into a tire. Corrosion and oxidation can result in poor adhesion between the cord and rubber and more importantly in a deterioration of the physical properties of the cord.

Various chemical reagents such as benzotriazole (BTA) have been proposed to protect such wire against corrosion and oxidation. Such reagents are described in copending applications. These reagents normally have been applied by immersing the wire in a water solution of the reagent. The wire is then dried to remove the water. The reagents react with wire to offer it protection against oxidation and/or corrosion. For example, BTA reacts with the copper to form a polymer layer. This layer must be sufficiently thin to allow a sulfur/-copper bond to be formed between the wire and the adjacent rubber within the tire, and yet the film must be of such a continuous uniformity as to facilitate resistance to corrosion.

Water application of reagents such as BTA requires lengthy immersion and drying times which can be expensive in commercial operations. The poor wetability of metal cord contributes to the length of the immersion time. The porosity of the brass coating presents the possibility that water may be occluded and therefore difficult to remove by drying. There is also the possibility that it will be difficult for the water to penetrate the porous openings because of surface tension effects. Where the tire filament is freshly drawn, the filament is cooled by the water immersion thereby requiring expensive reheating of the cord both to dry the cord and to promote the reaction between the reagents and the cord. It is therefore necessary that a method be found which does not require the use of expensive equipment and which permits the rapid treatment of the cord.

It is an object of the present invention to provide an efficient, low cost method of applying protective agents to brass coated steel wire, said method being capable of rapidly treating the wire and reaching even remote surfaces of the wire. It is also an object of the present invention to provide a method which will not require the use of drying equipment or other expensive and time consuming follow-up treatments. It is still another object of the present invention to provide treated brass coated steel tire cord possessing effective corrosion resistance.

The objects of the present invention can be accomplished by treating the cord during the course of its preparation or thereafter with reagents capable of promoting and/or retaining adhesion between the metal cord and adjacent vulcanized rubber and/or capable of improving the resistance of the cord to corrosion prior to incorporation into the tire during and after incorporation into the tire, said reagent being in a solid or molten state. Said reagents include compounds capable of preventing the oxidation of the steel substrate and/or capable of preventing the corrosion of the brass. The only limitation regarding the use of the reagent in solid form is that on coming in contact with the wire, that portion directly in contact with the wire becomes molten.

The process of the present invention can be used to treat the filament after drawing but before stranding, after stranding to form the cord, in the form of woven fabric or as multiple ends such as may be used at a creel calendering operation. In fact, the method can be used at any point in the manufacture of the cord and even subsequent thereto, the only requirement being that the cord be treated at some point before it becomes a reinforcing element in the tire or other rubber product.

The reagents of the present invention include, but are not limited to, reagents selected from the group consisting of precipitation compounds, oxidizing compounds, and compounds having the following structural formula

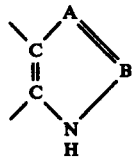

wherein the adjacent carbon atoms are joined to form a benzene or naphthylene ring, said ring being substituted (for example, with a single methyl group) or unsubstituted and wherein A and B are selected from the group consisting of —N— or —CH—, with the proviso that A and B are never both —CH—, said agent being in the form of a solid or a liquid. The precipitation compounds include compounds selected from the group consisting of organic borates organic phosphate and organic metaphosphates. The oxidation compounds include organic nitrites.

The precipitation compounds offer their protection through an indirect oxidizing (buffering) mechanism. The oxidation compounds offer protection by directly oxidizing metallic ions in the substrate surface.

Examples of organic compounds which can be used in the practice of the present invention include organic alkyl, cycloalkyl and aryl derivatives of m-boric acid, o-boric acid and pyro-boric acid as well as m-, o-, pyro- and hypo-phosphoric acid.

Preferably the reagent contains some moisture since water enhances the ability of the agents to prevent corrosion and to provide improved aged adhesion, that is, to retain to some measure the original adhesion. Said moisture can be introduced in any manner while the wire is being exposed to the reagent. Another embodiment involves exposing the cord to an atmosphere having a high moisture content prior to or subsequent to the liquid or solid treatment.

Any manner of exposing the cord to the solid or liquid form of the reagent will result in some improvement in corrosion or oxidation resistance.

Optimum conditions can be routinely determined for each system and will depend upon such variables as wire temperature, exposure time, the reagent used, etc.

The wire can be used as treated or subsequently heated to flash off excess reactants and/or to continue the reaction between the reagent and the wire to the desired state of completion, if the desired state has not already been reached.

In one embodiment the wire is simply passed through the molten reagent. In another embodiment it is passed through a solid, for example, but not limited to, in powdered form, the wire being at a temperature above the melting point of the reagent so as to melt the solid adjacent to the surface of the wire. Excess reagent may attach itself to the surface of the wire whether it be a filament or a cord. This can be more prevalent where the wire has interstices. Since excess reagent on the surface of the wire can be detrimental to adhesion, the excess material must be removed in some manner, for example by flashing it off with heat.

By passing the wire through the molten or meltable solid reagent, the disadvantages of the aqueous solution treatment are avoided. In addition, the wire is exposed to the reagent in its most concentrated form.

The agents can be used alone or in combination. Likewise a series of units can be used, each containing a different agent. It is preferred that one stage of the treatment involve the use of a BTA-type chemical agent.

The brass coated steel cord which can benefit by the practice of the present invention includes cord treated by methods or with material other than described herein, but which are still susceptible to oxidation and/or corrosion.

As mentioned earlier, if moisture is desired, it can be introduced, for example, by the introduction of steam into the reaction area, the addition of water to the molten agents, etc. The manner by which the water is introduced is not critical.

There is no reason why the present method can not be combined with other methods. For example, the wire can be first treated in an aqueous solution of one reagent followed by treatment with the BTA type material in molten or solid form.

In selecting agents, order of treatment, etc., one should consider that film formation with compounds such as BTA can possible cover the exposed steel so as to minimize contact thereof with other agents.

It is believed that a reduction of the porosity, for example by film formation on the cord surface, may result in improved corrosion resistance and adhesion retention.

As a guideline, but not a limitation, one can measure the porosity of the wire by immersing it in a potassium ferrocyanide solution. The darker the resulting cord, the greater its porosity. In this way the degree of porosity can be estimated before, during, and after treatment.

The brass coating of a typical brass coated steel cord is microscopically porous, thereby exposing small areas of steel surface to any surrounding environment. It is believed that BTA interacts with copper in a brass coating to form a polymeric complex of BTA plus copper. This polymeric complex is insoluble in most solvents and serves as a protective barrier to any environmental degradation of the underlying brass. On the other hand, anions from the precipitation and oxidation compounds, it is theorized, interact with iron and iron oxide from steel surfaces exposed through microscopic pores to form an adherent oxide film which protects the steel. It is not necessary that the barrier layers of polymeric complexes adsorbed be extremely thick. In fact, as mentioned earlier, such layers should not be so thick as to interfere with the sulfur reaction required for bonding the wire to the rubber, the adhesion of rubber to metal cord requiring the formation of copper-sulfur bonds.

The practice of the present invention results in increased surface protection of brass coated steel prior to rubber encapsulation and improved aged adhesion of vulcanized brass coated steel/rubber composites. It also prevents cord failure due to excessive corrosion during the use of the product, e.g., a tire being reinforced with the cord.

The rubber surrounding the metal can be any rubber, preferably diene rubbers such as natural rubber, rubbery copolymers of butadiene with styrene or acrylonitrile, polybutadiene and polyisoprene.

The fact that the adhesion between the copper in the brass and the adjacent rubber is dependent upon the presence of sulfur requires the use in the adjacent rubber of either free sulfur or a compound capable of donating sulfur such as 2-(morpholinodithio)benzothiazole.

Aged metal to rubber adhesion is particularly poor when the rubber contains oxygen, moisture, and an amine resin capable of releasing ammonia. For example, rubbers containing hexamethylenetetramine (HMTA) such as in a resorcinol/HMTA in situ resin system, where oxygen and moisture levels are sufficiently high, can tend to have poor aged-adhesion to brass or brass coated steel. The use of the present process is particularly beneficial in such systems. Further, coatings on in-process wire protect the wire from deleterious effects of moisture (humidity) and oxidation, i.e., improve factory storage life.

By the term "high-carbon" steel as used in the present specification and claims, applicant is referring to what is known as carbon steel, also called ordinary steel, also called straight carbon steel or plain carbon steel, e.g., American Iron and Steel Institute Grade 1070 high-carbon steel (AISI 1070). Such steel owes its properties chiefly to the presence of carbon without substantial amounts of other alloying elements. In this respect see Metals Handbook, The American Society for Metals, Metals Park, Cleveland, Ohio.

The term "brass" includes, but is not limited to, alpha brass or compositions in which the major component is alpha brass, i.e., which contain from about 65 to 75 percent copper and 35 to 25 percent zinc, respectively.

The following examples contain illustrations of, but do not limit the practice of the present invention. The adhesion data was obtained on cable embedded in black loaded unvulcanized natural rubber which was then vulcanized.

EXAMPLE 1

A drawn brass coated steel cable at room temperature was passed slowly (possibly at a speed of about 25 to 50 yards per minute) through a tube containing molten benzotriazole (BTA). The cable was then subjected to an ultra high temperature to flash off the excess BTA. The initial adhesion of the treated cable to vulcanized carbon black loaded natural rubber was 37 kilograms.

The corrosion resistance of the cable in a high temperature, high humidity environment was rated excellent.

EXAMPLE 2

A tube of molten BTA was mounted on a draw machine. A hot drawn brass coated steel filament as it exited the draw machine was passed through a ¾ inch thickness of molten BTA at a speed of 900 meters per minute. A cable prepared therefrom had an initial adhesion of 40.4 and a wet adhesion of 40.0. Its corrosion resistance was excellent. An untreated control had an initial adhesion of 59 and a wet adhesion (unvulcanized rubber soaked in water before the cable was embedded therein) of 34. The corrosion resistance was rated poor.

EXAMPLE 3

A brass coated steel filament was passed through a 12 inch tube of powdered BTA at a rate of 900 meters per minute after exiting from a draw machine. The filament was at a temperature of about 200° C. The powder temperature was varied from room temperature to 120° C. to 180° C. A cable was prepared from the resultant filament and checked for adhesion.

| Powder Temperature (8°C.) | Adhesion | | Corrosion Resistance |
|---|---|---|---|
| | Initial | Wet | |
| Room Temperature | 49 | 43 | Excellent |
| 120° C. | 41 | 31 | Excellent |
| 180° C. | 45 | 38.5 | Excellent |

The untreated control for room temperature and 180° C. had initial and wet adhesion values of 57 and 29 respectively. The untreated control for 120° C. had initial and wet adhesion values of 44 and 24. Therefore the treatment resulted in wet adhesion improvements at each temperature.

Once the cord is plated with the brass, treatment can begin. Treatment can occur with the reagents between the plating and drawing steps or between the drawing and stranding steps and even on the final cord prior to calendering. Where the treatment results in film formation, it is preferably accomplished after drawing since drawing will naturally destroy the film continuity.

An compound could have been substituted for BTA type compounds, which complexes with the copper in the brass to form an insoluble film, i.e., insoluble in any of the environments to which the material is to be exposed. These compounds include triazoles, imidazoles and indazoles. Such compounds include those compounds conforming to the structural formula recited earlier herein. The only requirement is that the agent be meltable.

Any of the previous working examples could have involved a subsequent heat treatment and/or exposure of the wire to water vapor.

Other materials which can be used, for example, to treat wire using the present method are triethyl phosphate and amyl nitrite.

While certain representative embodiments and details have been shown for the purpose of illustrating the invention, it will be apparent to those skilled in this art that various changes and modifications may be made therein without departing from the spirit or scope of the invention.

What is claimed is:

1. In a process of treating a brass coated steel filament with a reagent reactive with the brass surface or exposed steel surface of the filament so as to promote and/or retain adhesion between a cord comprised thereof any adjacent vulcanized rubber, and/or which improves the resistance of the filament or cord to corrosion, the improvement wherein the filament is either (a) passed through said reagent in its molten form or (b) passed through said reagent in its solid form with the temperature of the wire being above the melting point of the reagent so that the portion of the solid reagent in direct contact with the surface of the filament is in molten form.

2. In the process of claim 1 wherein the filament is treated with the reagent subsequent to a step of drawing the wire and the reagent is benzotriazole.

3. In the process of claim 2 wherein the reagent is benzotriazole.

4. In the process of claim 1 wherein the filament is subjected to heat treatment and/or water vapor treatment subsequent to the molten reagent treatment.

5. In a process of treating a brass coated steel cord comprised of one or more brass coated steel filaments with a reagent reactive with the brass surface or exposed steel surface of the cord so as to promote and/or retain adhesion between the cord and any adjacent vulcanized rubber and/or which improves the resistance of the cord to corrosion, the improvement wherein the cord is either (a) passed through said reagent in its molten or (b) passed through said reagent in its solid form with the temperature of the wire being above the melting point of the solid reagent so that the portion of the reagent in direct contact with the surface of the cord is in molten form.

6. In the process of claim 5 where the cord is subsequently subjected to heat treatment and/or water vapor treatment.

* * * * *